US011434446B2

(12) United States Patent
Champagne et al.

(10) Patent No.: US 11,434,446 B2
(45) Date of Patent: Sep. 6, 2022

(54) HYDRAULIC COMPOSITION FOR EXTREME COLD

(71) Applicant: TOTAL MARKETING SERVICES, Puteaux (FR)

(72) Inventors: Nicolas Champagne, Caluire (FR); Eric Rapin, Communay (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/760,798

(22) PCT Filed: Oct. 30, 2018

(86) PCT No.: PCT/EP2018/079660
§ 371 (c)(1),
(2) Date: Apr. 30, 2020

(87) PCT Pub. No.: WO2019/086423
PCT Pub. Date: May 9, 2019

(65) Prior Publication Data

US 2020/0339905 A1 Oct. 29, 2020

(30) Foreign Application Priority Data

Oct. 31, 2017 (FR) ..... 1760289

(51) Int. Cl.

| | |
|---|---|
| ***C10M 169/02*** | (2006.01) |
| ***C10M 119/12*** | (2006.01) |
| ***C10M 119/18*** | (2006.01) |
| ***C10N 30/02*** | (2006.01) |
| ***C10N 30/08*** | (2006.01) |
| ***C10N 40/08*** | (2006.01) |
| ***C10N 20/02*** | (2006.01) |
| ***C10N 30/00*** | (2006.01) |

(52) U.S. Cl.
CPC ..... *C10M 169/02* (2013.01); *C10M 119/12* (2013.01); *C10M 119/18* (2013.01); *C10M 2203/1025* (2013.01); *C10M 2205/0285* (2013.01); *C10M 2209/003* (2013.01); *C10M 2209/084* (2013.01); *C10M 2209/106* (2013.01); *C10M 2209/1036* (2013.01); *C10N 2020/02* (2013.01); *C10N 2030/02* (2013.01); *C10N 2030/08* (2013.01); *C10N 2030/68* (2020.05); *C10N 2040/08* (2013.01)

(58) Field of Classification Search
CPC ..... C10M 101/02; C10M 119/12; C10M 119/18; C10M 169/02; C10M 2203/1025; C10M 2205/0825; C10M 2209/003; C10M 2209/084; C10M 2209/1036; C10M 2209/104; C10M 2209/106; C10N 2020/02; C10N 2030/02; C10N 2030/08; C10N 2030/36; C10N 2030/68; C10N 2040/08; C10N 2040/30
See application file for complete search history.

(56) References Cited

U.S. PATENT DOCUMENTS

| | | | |
|---|---|---|---|
| 9,914,893 B2 | 3/2018 | Kashani-Shirazi et al. | |
| 2012/0108482 A1 | 5/2012 | Greaves et al. | |
| 2014/0194332 A1 | 7/2014 | Kamata et al. | |
| 2014/0303053 A1 | 10/2014 | Greaves | |
| 2016/0348024 A1 * | 12/2016 | Kashani-Shirazi | C10M 107/34 |

FOREIGN PATENT DOCUMENTS

| | | | |
|---|---|---|---|
| WO | WO-2007042560 | 4/2007 | |
| WO | WO-2007042560 A1 * | 4/2007 | C10M 145/14 |
| WO | WO-2016185047 A1 * | 11/2016 | C10G 45/00 |

OTHER PUBLICATIONS

International Search Report for PCT/EP2018/079660, dated Jan. 24, 2019.
Written Opinion of the International Searching Report for PCT/EP2018/079660, dated Jan. 24, 2019.
French Search Report for FR 1760289, dated Jun. 14, 2018.

* cited by examiner

*Primary Examiner* — James C Goloboy
(74) *Attorney, Agent, or Firm* — B. Aaron Schulman, Esq.; Stites & Harbison, PLLC

(57) ABSTRACT

The invention relates to the field of lubricants and provides a lubricating composition comprising at least one base oil, the kinematic viscosity of which measured at 40° C. does not exceed 10 $mm^2/s$ and the pour point of which does not exceed −50° C., and at least one thickener, said lubricating composition having a pour point not exceeding −55° C.

25 Claims, No Drawings

HYDRAULIC COMPOSITION FOR EXTREME COLD

The invention relates to the field of lubricants and in particular to the field of lubricant compositions used as hydraulic fluid, more particularly employed at very low temperatures.

The development of operations in polar climates (e.g. in Russia, Siberia) requires the adapting of some public works machinery such as construction machinery, diggers, hauling units, to allow operation thereof at temperatures lower than −40° C. Said machinery is unable to operate with usual hydraulic compositions under such temperature conditions.

To operate at such temperatures, the lubricant composition must have a very low pour point, generally lower than −55° C. and a viscosity index higher than 300 to allow stabilisation of the lubricant composition's viscosity irrespective of temperature.

Therefore, lubricant compositions intended to be used at temperatures lower than −40° C. may comprise base oils having a high viscosity index such as silicones, but this type of oil is costly however and little adapted to industrial use. It is known to add a polymer to a highly fluid mineral oil to improve the viscosity index thereof. This is notably the case with hydraulic fluids which combine a highly fluid naphthenic or paraffinic oil with a viscosity index-improving polymer such as polymethyl methacrylate (PMMA).

One problem encountered with said hydraulic fluids when used at temperatures lower than 40° C. is their poor stability under shear, which can translate as a major loss of the fluid's kinematic viscosity. This poor stability under shear is due to the generally large addition of polymer (30 to 50 weight % of active material) to the lubricant composition. A further problem encountered when said hydraulic fluids are used at temperatures below 40° C. is the poor storage stability thereof which can translate as demixing of the polymer and base oil.

In addition to poor resistance to shear, said lubricant composition may not be compatible with the sealing materials of the installation, nitrile seals in particular, due to the choice of base oil. In particular, swelling of nitrile seals may possibly be observed in contact with the lubricant composition.

There is therefore a need to provide lubricant compositions allowing the operation of machinery at low temperatures e.g. at temperatures lower than −40° C., in particular in a polar environment, these compositions preferably having good stability under shear, good storage stability and acceptable compatibility with seals.

It has now been found that the combination of a base oil associating a very low pour point and low kinematic viscosity at 40° C. with a thickener allows a storage-stable lubricant composition to be obtained having a very low pour point, allowing the operation of machinery at very low temperatures and preferably ensuring good stability under shear together with good seal compatibility.

The invention therefore provides a hydraulic composition which brings a solution to all or some of the problems with lubricant compositions intended to be used at very low temperature.

The present invention provides a lubricant composition comprising:

at least one base oil having kinematic viscosity measured at 40° C. less than or equal to 10 $mm^2/s$ and having a pour point lower than or equal to −50° C.; and at least one thickener selected from among:

polyalkylene glycols (PAGs) comprising at least 50 weight % of butylene oxide repeat units and having kinematic viscosity measured at 100° C. according to standard ASTM D445 (2015) greater than or equal to 50 $mm^2/s$, kinematic viscosity measured at 40° C. according to standard ASTM D445 (2015) greater than or equal to 500 $mm^2/s$ and a viscosity index measured according to standard ASTM D2270 (2012) higher than or equal to 160;

linear or branched alkoxylated polyethylene glycols; and mixtures thereof;

said lubricant composition having a pour point lower than or equal to −55° C.

Advantageously, the lubricant composition of the invention has a pour point lower than or equal to −60° C. Pour points of −55, −56, −57, −58, −59, −60, −61, −62, −63, −64, −65° C. can be cited as examples.

The pour point of the lubricant composition is measured according to standard ASTM D97.

Advantageously the lubricant composition of the invention has a high viscosity index, higher than or equal to 300, and a very low pour point lower than or equal to −55° C. Therefore, advantageously, the lubricant composition of the invention can be used at extreme temperatures and in particular at temperatures lower than −40° C. Additionally and advantageously, the composition of the invention displays good stability under shear and has good storage stability.

Advantageously, the base oil of the lubricant composition of the invention is characterized by kinematic viscosity measured at 40° C. less than or equal to 10 $mm^2/s$, preferably kinematic viscosity at 40° C. is between 1 and 10 $mm^2/s$, more preferably between 2 and 10 $mm^2/s$, further preferably between 2 and 8 $mm^2/s$ and advantageously the kinematic viscosity at 40° C. of the base oil is between 2 and 4 $mm^2/s$.

The viscosity of the base oil of the composition of the invention at 40° C. is measured according to ISO standard 3104 of 15 Jul. 1997.

Advantageously, the base oil of the lubricant composition of the invention is characterized by a pour point lower than or equal to −50° C.

The pour point is measured according to ISO standard 3016 of Aug. 1, 1994.

The base oil(s) used in the lubricant composition of the invention must have the above physical characteristics and can be selected from a broad range. The base oil of the lubricant composition used in the invention can particularly be selected from among mineral, biosourced, animal, vegetable oils or synthetic oils. The base oil(s) of the invention can be biosourced oils, oils of vegetable, mineral or synthetic origin selected from among oils in Groups III to V according to the API classification (or equivalents under ATIEL classification) (Table A), alone or in a mixture.

TABLE A

| | Saturates content | Sulfur content | Viscosity Index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |

TABLE A-continued

| | Saturates content | Sulfur content | Viscosity Index (VI) |
|---|---|---|---|
| Group IV | polyalphaolefins (PAOs) | | |
| Group V | esters and other bases not included in Groups I to IV | | |

The mineral base oils able to be used in the invention include all types of bases obtained by atmospheric and vacuum distillation of crude oil, followed by refining operations such as solvent extraction, deasphalting, solvent dewaxing, hydrotreatment, hydrocracking, hydroisomerization and hydrofinishing, and having the above-described characteristics of pour point and viscosity. Mixtures of synthetic and mineral oils can also be employed.

Preferably, the base oil(s) of the lubricant composition of the invention are selected from among Group IV oils or Group V oils.

Preferably, the base oil(s) of the lubricant composition of the invention are selected from among biosourced oils.

The base oils of the lubricant compositions used in the invention can also be selected from among biosourced oils such as derived from hydrogenation of vegetable biomass. The vegetable biomass can be a vegetable oil, an ester or triglyceride derived from this vegetable oil.

Preferably, the Group V base oil of the invention is selected from among iso-paraffinic oils preferably containing more than 90 weight % of iso-paraffin, preferably more than 95 weight % and more particularly more than 98 weight %, and having an aromatic content of less than 300 ppm, preferably less than 100 ppm, more preferably less than 50 ppm, further preferably less than 20 ppm. In general, the aromatic content is measured by UV.

Preferably, this base oil contains less than 3 weight % of naphthene, preferably less than 1% and further preferably less than 100 ppm.

Preferably, this base oil is characterized by an iso-paraffin/n-paraffin weight ratio higher than or equal to 12:1, more preferably higher than or equal to 15:1, and advantageously higher than or equal to 20:1.

Preferably, this base oil has from 6 to 30 carbon atoms, preferably 8 to 24, more preferably 9 to 20.

Preferably, this base oil contains less than 5 ppm, more preferably less 3 ppm, and advantageously less than 0.5 ppm of sulfur.

Preferably, this base oil is characterized by a boiling point of between 100 and 400° C., more preferably between 150 and 400° C., further preferably between 200 and 400° C., still further preferably between 220 and 340° C. and advantageously between 250 and 340° C.

The base oils of the lubricant compositions of the invention can also be selected from among polyalphaolefins (PAOs) such as PAO2, «gas to liquid»oils (GTL) such as GTL2, biosourced oils such as farnesane, from isoparaffins obtained by hydrocracking and hydrodearomatization process such as those in the ISANE® range marketed by TOTAL FLUIDES, or dearomatized aliphatic oils such as Hydroseal® oils marketed by TOTAL FLUIDES.

Apolar fluids such as those in the Berylane® range marketed by TOTAL FLUIDES can also be used as base oils; similarly, and more generally use can be made of renewable fluids.

Preferably, the Group IV base oil of the invention is selected from among polyalphaolefins (PAOs) such as PAO2.

Advantageously, the lubricant composition of the invention comprises 50 to 85 weight of base oil relative to the total weight of the composition, preferably 55 to 80% and more preferably 60 to 75%.

In addition to the base oil selected from among the Group III to V oils defined above, the lubricant composition of the invention may optionally comprise a secondary base oil in small proportion.

The secondary base oil of the composition of the invention is selected from among Group I or II base oils as defined in the API classification (or their equivalents in the ATIEL classification) (Table A) alone or in a mixture.

Preferably, the content of secondary base oil in the lubricant composition of the invention is less than or equal to 10%, preferably less than or equal to 5 weight % relative to the total weight of the lubricant composition.

The lubricant composition of the invention may also comprise at least one thickener selected from among:

- polyalkylene glycols (PAGs) comprising at least 50 weight % of butylene oxide repeat units and having kinematic viscosity measured at 100° C. according to ASTM D445 (2015) greater than or equal to 50 $mm^2/s$, kinematic viscosity measured at 40° C. according to standard ASTM D445 (2015) greater than or equal to 500 $mm^2/s$, and a viscosity index measured according to standard ASTM D2270 (2012) higher than or equal to 160;
- linear or branched alkoxylated polyethylene glycols; and mixtures thereof.

In the present application, by thickener it is meant a compound, preferably a polymeric compound, used to increase the kinematic viscosity of the base oil and characterized by a thickening factor of less than 1. The thickening factor corresponds to the ratio between specific viscosity at 98° C. (210° F.) and specific viscosity at 37° C. (100° F.). The thickening factor is defined in particular in the publication: «Influence of base oil refining on the performance of viscosity index improvers»H. Singh et al. (Wear, 118, 33-56, 1987), on page 47.

It is to be understood, in the present invention, that the base oil and PAG are two separate compounds.

Preferably, the PAG of the invention comprises at least 80 weight % of butylene oxide repeat units.

More preferably, the PAG of the invention is a PAG having alkylene repeat units that are solely butylene oxide repeat units.

The PAG of the invention is therefore described as a PAG of which the alkylene oxide repeat units are selected from among butylene oxide repeat units with at least 50 weight %, preferably at least 80 weight %, more preferably 100 weight % of butylene oxide repeat units.

In particularly advantageous manner, the PAG of the invention is soluble in the base oil and advantageously irrespective of temperature.

Preferably, the PAG is obtained by polymerization or copolymerization of butylene oxides. In particular, the PAG of the invention can be prepared with known methods notably described in US20120108482, and in particular via reaction of one or more alcohols having 2 to 12 carbon atoms, particularly polyol and preferably a diol, with butylene oxides and propylene oxide. The alcohols are particularly diols and preferably 1,2-propanediol. The butylene oxide can be selected from between 1,2-butylene oxide and 2,3-butylene oxide, preferably 1,2-butylene oxide.

If the PAG only comprises butylene oxide repeat units, the method described in US20120108482 is adapted to the sole use of butylene oxide.

Preferably, the PAG of the invention comprises from 25 to 300 moles of butylene oxide repeat units, preferably 50 to 200 moles.

Preferably the PAG of the invention has an O/C weight ratio (oxygen atom/carbon atom) of between 0.29 and 0.38, preferably between 0.29 and 0.35.

Preferably, the PAG of the invention has a molecular weight of between 5000 and 200000 g/mol.

Preferably, the PAG of the invention has kinematic viscosity measured at 100° C. according to standard ASTM D445 (2015) of between 50 and 500 $mm^2/s$, kinematic viscosity measured at 40° C. according to standard ASTM D445 (2015) of between 500 and 4500 $mm^2/s$, and a viscosity index measured according to standard ASTM D2270 (2012) of between 160 and 300.

The PAGS used in the invention are such as described in patent application US2014/303053 and are incorporated herein by reference.

The alkoxylated polyethylene glycols used in the invention are such as described in patent application US2016/348024 and are incorporated herein by reference.

Preferably, the alkoxylated polyethylene glycols of the invention are of general formula (I):

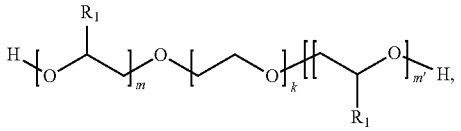

(I)

where:

m is an integer of between 0 and 30;

m' is an integer of between 0 and 30;

(m+m') is an integer of between 1 and 60;

k is an integer between 2 and 50;

and $R_1$ designates a linear or branched, non-substituted alkyl radical having 6, 7, 8, 9, 10, 11, 12, 13, 14, 15, 16, 17, 18, 19, 20, 21, 22, 23, 24, 25, 26, 27 or 28 carbon atoms, whereby the concatenations denoted by k, m and m' are distributed to form a block polymeric structure.

More preferably, the alkoxylated polyethylene glycols of the invention are of general formula (II):

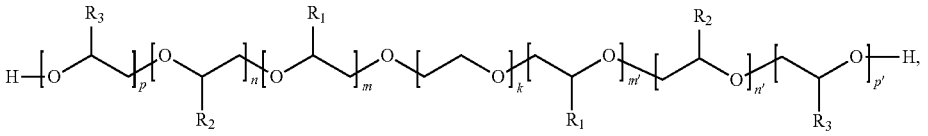

(II)

where:

m is an integer between 1 and 50;

m' is an integer between 1 and 50;

(m+m') is an integer between 1 and 90;

n is an integer between 0 and 75;

n' is an integer between 0 and 75;

P is an integer between 0 and 90;

P' is an integer between 0 and 90;

k is an integer between 2 and 50;

$R_1$ designates a linear or branched, non-substituted alkyl radical having 6, 7, 8, 9, 10, 11, 12, 13, 14, 15, 16, 17, 18, 19, 20, 21, 22, 23, 24, 25, 26, 27 or 28 carbon atoms;

$R_2$ is —CH2—CH3; and $R_3$ is —CH3.

Such as used in the present invention, "branched" designates a chain of atoms having one or more side chains attached thereto. Branching occurs via the replacing of a substituent e.g. a hydrogen atom by a covalently bound alkyl radical.

Such as used in the present invention "radical alkyl" designates a fraction composed solely of carbon and hydrogen atoms and not containing any double bond.

Preferably, the alkoxylated polyethylene glycol such as defined in the invention has kinematic viscosity at 40° C. of between 40 $mm^2/s$ and 1300 $mm^2/s$, more preferably between 50 $mm^2/s$ and 1200 $mm^2/s$, further preferably between 70 $mm^2/s$ and 1000 $mm^2/s$, most preferably between 100 $mm^2/s$ and 500 $mm^2/s$, determined according to ASTM D 445.

Preferably, the alkoxylated polyethylene glycol such as defined in the invention has kinematic viscosity at 100° C., of between 10 $mm^2/s$ and 100 $mm^2/s$, more preferably between 12 $mm^2/s$ and 80 $mm^2/s$, further preferably between 14 $mm^2/s$ and 65 $mm^2/s$, most preferably between 15 $mm^2/s$ and 60 $mm^2/s$, determined according to standard ASTM D 445.

Preferably, the alkoxylated polyethylene glycol such as defined in the invention has a viscosity index of between 100 and 300, more preferably between 120 and 280, further preferably between 140 and 250, determined according to ASTM D 2270.

Advantageously, the alkoxylated polyethylene glycol such as defined in the invention has a viscosity index of 200±60, more preferably 200±50, further preferably 200±40, most preferably 200±30, determined according to standard ASTM D 2270.

Preferably, the alkoxylated polyethylene glycol such as defined in the invention has a pour point of between −60° C. and 20° C., more preferably between −50° C. and 15° C., further preferably between −50° C. and 5° C., most preferably between −50° C. and −5° C., determined according to DIN ISO 3016.

Preferably, the alkoxylated polyethylene glycol in the invention has a weight average molecular weight Mw of between 500 and 20000 g/mol, more preferably between 2000 and 15000 g/mol, advantageously between 3000 and 12000 g/mol, further preferably between 4000 and 10000 g/mol, and in particular between 4000 and 8000 g/mol, determined according to standard DIN 55672-1.

Preferably, the alkoxylated polyethylene glycol such as in the invention has polydispersity of between 1.05 and 1.60, more preferably between 1.05 and 1.50, most preferably between 1.10 and 1.45, determined according to DIN 55672-1.

Preferably, the alkoxylated polyethylene glycol such as in the invention has a hydroxyl value of between 5 and 50 mg KOH/g, more preferably between 5 and 40 mg KOH/g, further preferably between 5 and 35 mg KOH/g, determined according to DIN 53240.

The alkoxylated polyethylene glycols of the invention are obtained by reacting at least one polyethylene block polymer with at least one C8-C30 epoxy-alkane and optionally at least one epoxide selected from the group composed of ethylene oxide, propylene oxide and butylene oxide in the presence of at least one catalyst.

If at least one epoxide is used, selected from the group composed of ethylene oxide, propylene oxide and butylene oxide, the at least one C8-C30 epoxy-alkane and the at least one epoxide selected from the group composed of ethylene oxide, propylene oxide and butylene oxide can be added either in the form of a mixture of epoxides to obtain a random copolymer, or portion-wise, each portion containing a different epoxide to obtain a block copolymer.

Preferably, the at least one C8-C30 epoxy-alkane is selected from the group formed by 1,2-epoxyoctane; 1,2-epoxynonane; 1,2-epoxydecane; 1,2-epoxyundecane; 1,2-epoxydodecane; 1,2-epoxytridecane; 1,2-epoxytetradecane; 1,2-epoxypentadecane; 1,2-epoxyhexadecane; 1,2-epoxyheptadecane; 1,2-epoxyoctadecane; 1,2-epoxynonadecane; 1,2-epoxyicosane; 1,2-epoxyunicosane; 1,2-epoxydocosane; 1,2-epoxytricosane; 1,2-epoxytetracosane; 1,2-epoxpentacosane; 1,2-epoxyhexacosane; 1,2-epoxyheptacosane; 1,2-epoxyoctacosane; 1,2-epoxponacosane and 1,2-epoxytriacontane.

The lubricant composition of the invention comprises between 5 and 50 weight % of active thickening material, more particularly between 10 and 45 weight % of active thickening material relative to the total weight of the lubricant composition, preferably from 15 to 45%.

Preferably, the lubricant composition of the invention may also comprise at least one viscosity index improver selected from among poly(alkyl) methacrylates (PAMAs) and hydrogenated styrene-isoprene copolymers (SIPs).

It is to be understood that in the present invention, the thickener and viscosity index improver included in the lubricant composition are two different compounds, in particular two compounds of different chemical type.

Preferably, the lubricant composition of the invention can additionally comprise between 5 and 20 weight % of active viscosity index improver relative to the total weight of the composition, preferably from 5 to 15%.

The PAMAs or SIPs contained in the composition of the invention are polymers able to be found in any configuration: linear, grafted, comb- or star-shaped.

PAMAs can be characterized by a molecular weight of between 55 000 and 80 000 g/mol, molecular weight being measured by 3D-GPC.

In particular, the viscosity improver is selected from among PAMAs.

As PAMA example of the invention, mention can be made of Viscoplex 7-200® by Evonik.

The molecular weights of the viscosity improvers of the invention are for example between 55 000 et 100 000 $g/mol^{-1}$.

The lubricant composition of the invention may also comprise at least one or more additives.

The preferred additives for the lubricant composition used in the invention are selected from among anti-wear additives, extreme-pressure additives, friction-modifying additives, antioxidants, detergent additives, dispersants, defoaming agents, de-emulsifiers, lubricity improvers and mixtures thereof.

Anti-wear additives and extreme-pressure additives protect rubbing surfaces through the formation of a protective film adsorbed on these surfaces. There is a large variety of anti-wear additives. Anti-wear additives can be selected from among phospho-sulfurized additives such as metal alkylthiophosphates, in particular zinc alkylthiophosphates, and more specifically zinc dialkyldithiophosphates or ZnDTPs. The preferred compounds have the formula $Zn((SP(S)(OR^a)(OR^b))_2$ where $R^a$ and $R^b$, the same or different, are independently an alkyl group, preferably an alkyl group having 1 to 18 carbon atoms. Advantageously for the lubricant composition of the invention, the anti-wear additives can also be selected from among zinc-free compounds such as amine phosphates, phosphites e.g. phosphite mono-, di- or triesters and dithiocarbamates e.g. amine dithiocarbamates. Advantageously, the lubricant composition used in the invention can comprise from 0.01 to 6 weight %, preferably 0.05 to 4 weight %, more preferably 0.1 to 2 weight % relative to the total weight of the lubricant composition of anti-wear additives and extreme-pressure additives.

Advantageously, the lubricant composition of the invention may comprise at least one friction modifying additive. The friction modifying additive can be selected from among a compound providing metal elements and an ashless compound. Among the compounds providing metal elements, mention can be made of transition metal complexes such as Mo, Sb, Sn, Fe, Cu, Zn, the ligands of which may be hydrocarbon compounds comprising atoms of oxygen, nitrogen, sulfur or phosphorus. Ashless friction modifying additives are generally of organic origin and can be selected from among the monoesters of fatty acids and polyols, alkoxylated amines, alkoxylated fatty amines, fatty epoxides, borate fatty epoxides; fatty amines or fatty acid glycerol esters. In the invention, the fatty compounds comprise at least one hydrocarbon group having 10 to 24 carbon atoms. Advantageously, the lubricant composition used in the invention may comprise from 0.01 to 2 weight %, or 0.01 to 5 weight %, more preferably 0.1 to 1.5 weight % or 0.1 to 2 weight % of friction modifying additive relative to the total weight of the lubricant composition.

Advantageously, the lubricant composition of the invention may comprise at least one antioxidant additive. An antioxidant additive generally allows delayed degradation of the lubricant composition in use. This degradation may notably translate as the formation of deposits, as the presence of sludge or as an increase in viscosity of the lubricant composition. Antioxidant additives particularly act as radical inhibitors or hydroperoxide decomposers. Among the antioxidant additives frequently employed, mention can be made of antioxidant additives of phenolic type, antioxidant additives of amino type, phospho-sulfurized antioxidant additives. Some of these antioxidant additives e.g. phospho-sulfurized antioxidant additives may generate ash. Phenolic antioxidant additives can be ashless or can be in the form of neutral or basic metal salts. Antioxidant additives can be selected in particular from among sterically hindered phenols, sterically hindered phenol esters and sterically hindered phenols comprising a thioether bridge, diphenylamines, diphenylamines substituted by at least one $C_1$-$C_{12}$ alkyl group, N,N'-dialkyl-aryl-diamines, and mixtures thereof. Preferably, according to the invention, the sterically hindered phenols are selected from among compounds comprising a phenol group in which at least one vicinal carbon of the carbon carrying the alcohol function is substituted by at least one $C_1$-$C_{10}$ alkyl group, preferably a $C_1$-$C_6$ alkyl group, preferably a $C_4$ alkyl group, preferably by the tert-butyl group. Amino compounds are another class of antioxidant additives that can be used, optionally in combination with phenolic antioxidant additives. Examples of amino compounds are the aromatic amines e.g. the aromatic amines of formula $NR^cR^dR^e$ where $R^c$ is an aliphatic group or aromatic group, optionally substituted, $R^d$ is an aromatic group, optionally substituted, $R^e$ is a hydrogen atom, an alkyl group, an aryl group or group of formula $R^fS(O)_zR^g$ where $R^f$ is an alkylene group or alkenylene group, $R^g$ is an alkyl group, an alkenyl group or aryl group and z is 0, 1 or 2. Sulfurized alkyl phenols or the alkali or alkaline-earth metal salts thereof can also be used as antioxidant additives. Another class of antioxidant additives is that of copper compounds e.g. copper thio- or dithio-phosphates, copper and carboxylic acid salts, copper dithiocarbamates, sulfonates, phenates and acetylacetonates. Copper I and II salts, the salts of succinic acid or anhydride can also be used. The lubricant composition used in the invention may contain any type of antioxidant additive known to persons skilled in the art. Advantageously, the lubricant composition comprises at least one ashless antioxidant additive. Also advantageously, the lubricant composition used in the invention comprises 0.5 to 2% by weight of at least one antioxidant additive relative to the total weight of the composition.

The lubricant composition of the invention may also comprise at least one detergent additive. Detergent additives generally allow a reduction in the formation of deposits on the surface of metal parts by dissolving secondary oxidation and combustion products. The detergent additives that can be employed in the lubricant composition used in the invention are generally known to skilled persons. The detergent additives can be anionic compounds comprising a long lipophilic hydrocarbon chain and hydrophilic head. The associated cation can be a metal cation of an alkali or alkaline-earth metal. The detergent additives are preferably selected from among alkali metal or alkaline-earth metal salts of carboxylic acids, sulfonates, salicylates, naphthenates, and phenate salts. The alkali or alkaline-earth metals are preferably calcium, magnesium, sodium or barium. These metal salts generally comprise the metal in stoichiometric amount or in excess i.e. an amount greater than the stoichiometric amount. They are then overbased detergent additives; the excess metal imparting the overbased nature to the detergent additive is then generally in the form of an oil-insoluble metal salt e.g. a carbonate, hydroxide, an oxalate, acetate, glutamate, preferably a carbonate. Advantageously, the lubricant composition used in the invention may comprise from 2 to 4 weight % of detergent additive relative to the total weight of the lubricant composition.

Advantageously the lubricant composition of the invention may also comprise at least one dispersant. The dispersant can be selected from among Mannich bases, succinimides and derivatives thereof. Also advantageously, the lubricant composition used in the invention may comprise from 0.2 to 10% by weight of dispersant relative to the total weight of the lubricant composition.

The lubricant composition may also comprise a defoaming additive selected from among silicones and derivatives thereof, such as polysiloxanes and derivatives thereof. Said defoaming agent can be Bluesil 47V12500® marketed by Bluestar Silicones. The defoaming additive of the lubricant composition of the invention can also be selected from among acrylics such as PC1244® marketed by Mosanto.

Advantageously, the lubricant composition may also comprise a demulsifier selected from among polyethers and derivatives thereof such as the Embreak 2W6975® compounds marketed by General Electric, and Prochinor GR77® marketed by Arkema.

Preferably, the lubricant composition of the invention comprises at least one additive selected from among antioxidants, anti-wear additives, defoamers and demulsifiers.

Preferably, the lubricant composition of the invention may also comprise at least one lubricity-improving additive such as di-esters e.g. 2-ethylhexyl sebacate.

Advantageously, the lubricant composition of the invention has a viscosity index higher than or equal to 200, preferably higher than or equal to 250, more preferably higher than or equal to 300, and a pour point of between −50 and −66° C., preferably between −55 and 63° C.

The viscosity index is measured according to standard ISO 2909 of 15 Dec. 2002. These characteristics mean that the lubricant composition of the invention is particularly suitable for use at temperatures lower than −40° C.

Advantageously, the lubricant composition of the invention is characterized by good resistance to shear i.e. a KV100 variation lower than or equal to 26%, measured according to DIN 51350-6 of 1 Aug. 1996.

The lubricant composition of the invention is also characterized by compatibility with seal materials, in particular nitrile seals as measured by standard NF E 46-610 of 1 Feb. 2012. Two characteristics are measured to ensure the criterion of compatibility with nitrile seals: variation in volume which must lie between 0 and 12%, and variation in hardness which must lie between 0 and −7%.

The lubricant composition of the invention is particularly advantageous for use thereof as hydraulic fluid, in particular for industrial machinery at temperatures lower than −40° C.

The invention also concerns the use of a lubricant composition of the invention as lubricant composition for rotary compressor, in particular in a polar climate.

According to the invention, the particular, advantageous or preferred characteristics of the lubricant composition of the invention allow the defining of uses of the invention which are similarly particular, advantageous or preferred.

The different aspects of the invention can be illustrated by the following examples.

EXAMPLE 1

Preparation of Lubricant Compositions CL1, CL2 and CL3 of the Invention

The different components of the lubricant compositions of the invention are mixed together according to the product types and amounts given in Table 1.

TABLE 1

| | Lubricant composition CL1 of the invention (wt. %) | Lubricant composition CL2 of the invention (wt. %) | Lubricant composition CL3 of the invention (wt. %) |
|---|---|---|---|
| Group V oil: KV40 = 2.49 $mm^2/s$ and pour point = −81° C.) | 51.02 | 0 | 48.02 |
| Group IV oil: KV40 = 5.2 $mm^2/s$ and pour point = −63° C.) | 0 | 62.02 | 0 |
| (Thickener) PAG, KV100 = 680 = 77 $mm^2/s$ (1) | 43.00 | 32.00 | 41.00 |
| Polyalkylmethacrylate, KV100 = 1200 mm2/s | 5.00 | 5.00 | 5.00 |
| Lubricity modifier (2) | 0 | 0 | 5.00 |
| Additive package | 0.98 | 0.98 | 0.98 |

(1) PAG, KV100 = 680 $mm^2/s$ commercially available from DOW under the trade nameUCON-OSP 680.
(2) Lubricity modifier being 2-ethylhexyl sebacate.
(3) The additive package is a conventional, commercial additive package particularly comprising a defoamer, anti-corrosion additive, antioxidant additive.

EXAMPLE 2

Measurement of the Characteristics of Lubricant Compositions CL1, CL2 and CL3

The characteristics of lubricant compositions CL1, CL2 and CL3 (kinematic viscosity, viscosity index and pour point) are given in Table 2.

TABLE 2

| | CL1 | CL2 | CL3 |
|---|---|---|---|
| Kinematic viscosity at 40° C. ($mm^2/s$) | 29.7 | 30.5 | 30.1 |
| Kinematic viscosity at 100° C. ($mm^2/s$) | 8.53 | 7.97 | 8.52 |
| Calculated viscosity index | 289 | 252 | 284 |
| Pour point (° C.) | −60 | −57 | −60 |
| Loss of viscosity at 100° C. after 20 h KRL shear | Less than 15% | Less than 15% | Less than 15% |

Kinematic viscosities at 40° C. and 100° C. were measured according to standard ISO 3104 of 15 Jul. 1997.

The lubricant compositions of the invention have good viscosifying properties in particular at 40 and 100° C.

The viscosity index was calculated according to standard ISO 2909 of 15 Dec. 2002. The pour point was measured according to standard ISO 3016 of 1 Aug. 1994.

Loss of viscosity at 100° C. after 20 h KRL shear was measured according to standard DIN 51350-6.

Loss of viscosity at 100° C. after 20 h KRL shear shows that the lubricant compositions of the invention have very good stability under shear.

The lubricant compositions of the invention are characterized by a pour point lower than or equal to −57° C., a viscosity index of between 252 et 289 and very low loss of viscosity after KRL shear.

These characteristics show that the lubricant compositions of the invention can be used as hydraulic fluid in polar climates. In addition, with their excellent shear resistance (KRL test), the lubricant compositions maintain their properties when in use.

The invention claimed is:

1. A lubricant composition comprising:

at least one base oil having kinematic viscosity measured at 40° C. less than or equal to 10 $mm^2/s$ and having a pour point lower than or equal to −50° C.; and at least one polyalkylene glycol (PAG) thickener comprising at least 50 weight % of butylene oxide repeat units and having kinematic viscosity measured at 100° C. according to standard ASTM D445 (2015) comprised between 50 and 500 mm2/s, said kinematic viscosity measured at 40 ° C. according to standard ASTM D445 (2015) comprised between 500 and 4500 mm2/s, and a viscosity index measured according to standard ASTM D2270 (2012) comprised between 160 and 300;

said lubricant composition having a pour point lower than or equal to −55° C.

2. The composition according to claim 1, further comprising a viscosity index improver.

3. The composition according to claim 1, wherein the base oil is selected from the group consisting of Group III, IV, and V oils.

4. The composition according to claim 1, wherein the base oil comprises more than 90 weight % of iso-paraffins, and less than 300 ppm of aromatics.

5. The composition according to claim 3, wherein the iso-paraffin/n-paraffin weight ratio characterizing the base oil is higher than or equal to 12:1.

6. The composition according to claim 1, wherein the base oil has kinematic viscosity measured at 40° C. of between 1 and 10 $mm^2/s$.

7. The composition according to claim 1, comprising from 50 to 85 weight % of base oil relative to the total weight of the composition.

8. The composition according to claim 1, wherein the PAGs comprise at least 80 weight % of butylene oxide repeat units.

9. The composition according to claim 1, wherein the content of active thickening material is between 5 and 50 weight % relative to the total weight of the lubricant composition.

10. The composition according to claim 1, comprising from 5 to 20 weight % of active viscosity improving material relative to the total weight of the composition.

11. A method of lubricating industrial machinery at temperatures lower than −40° C. comprising contacting mechanical parts of the industrial machinery needing an industrial lubricant or hydraulic fluid to be lubricated with a lubricant composition comprising:

a base oil having kinematic viscosity measured at 40° C. less than or equal to 10 $mm^2/s$ and having a pour point lower than or equal to −50° C.; and a polyalkylene glycol thickener comprising at least 50 weight % of butylene oxide repeat units and having kinematic viscosity measured at 100° C. according to standard ASTM D445 (2015) comprised between 50 and 500 $mm^2/s$, kinematic viscosity measured at 40° C. according to standard ASTM D445 (2015) comprised between 500 snf 4500 $mm^2/s$, and a viscosity index measured according to standard ASTM D2270 (2012) comprised betweeen 160 and 300said lubricant composition having a pour point lower than or equal to −55° C.

12. The method for lubricating parts of industrial machinery at temperatures lower than −40° C. according to claim 11, wherein the base oil is selected from the group consisting of Group III oils, Group IV oils, and Group V oils.

13. The method for lubricating parts of industrial machinery at temperatures lower than −40° C. according to claim 11, wherein the base oil comprises more than 90 weight % of iso-paraffins, and less than 300 ppm of aromatics.

14. The method for lubricating parts of industrial machinery at temperatures lower than −40° C. according to claim 13, wherein the iso-paraffin/n-paraffin weight ratio characterizing the base oil is higher than or equal to 12:1.

15. The method for lubricating parts of industrial machinery at temperatures lower than −40° C. according to claim 13, wherein the iso-paraffin/n-paraffin weight ratio characterizing the base oil is higher than or equal to 15:1.

16. The method for lubricating parts of industrial machinery at temperatures lower than −40° C. according to claim 13, wherein the iso-paraffin/n-paraffin weight ratio characterizing the base oil is higher than or equal to 20:1.

17. The method for lubricating parts of industrial machinery at temperatures lower than −40° C. according to claim 11, wherein the base oil has kinematic viscosity measured at 40° C. having a range selected from the group consisting of (a) between 1 and 10 $mm^2/s$; (b) between 2 and 10 $mm^2/s$' (c) between 2 and 8 $mm^2/s$; and (d) between 2 and 4 $mm^2/s$.

18. The method for lubricating parts of industrial machinery at temperatures lower than −40° C. according to claim

11, wherein the lubricating composition comprises from 50 to 85 weight % of base oil relative to the total weight of the composition.

19. The method for lubricating parts of industrial machinery at temperatures lower than −40° C. according to claim 11, wherein the lubricating composition comprises from 55 to 80 weight % of base oil relative to the total weight of the composition.

20. The method for lubricating parts of industrial machinery at temperatures lower than −40° C. according to claim 11, wherein the lubricating composition comprises from 60 to 75 weight % of base oil relative to the total weight of the composition.

21. The method for lubricating parts of industrial machinery at temperatures lower than −40° C. according to claim 11, wherein the PAGs comprise at least 80 weight % of butylene oxide repeat units.

22. The method for lubricating parts of industrial machinery at temperatures lower than −40° C. according to claim 11, wherein the content of active thickening material is between 5 and 50 weight % relative to the total weight of the lubricant composition.

23. The method for lubricating parts of industrial machinery at temperatures lower than −40° C. according to claim 11, wherein the content of active thickening material is between 10 and 45 weight % relative to the total weight of the lubricant composition.

24. The method for lubricating parts of industrial machinery at temperatures lower than −40° C. according to claim 11, wherein the lubricating composition comprises from 5 to 20 weight % of active viscosity improving material relative to the total weight of the composition.

25. The method for lubricating parts of industrial machinery at temperatures lower than −40° C. according to claim 11, wherein the lubricating composition comprises from 5 to 15 weight % of active viscosity improving material relative to the total weight of the composition.

* * * * *